US008730119B2

(12) United States Patent
Runyon et al.

(10) Patent No.: US 8,730,119 B2
(45) Date of Patent: May 20, 2014

(54) SYSTEM AND METHOD FOR HYBRID GEOMETRY FEED HORN

(75) Inventors: Donald Lawson Runyon, Johns Creek, GA (US); David Mark Kokotoff, Alpharetta, GA (US)

(73) Assignee: ViaSat, Inc., Carlsbad, CA (US)

( * ) Notice: Subject to any disclaimer, the term of this patent is extended or adjusted under 35 U.S.C. 154(b) by 553 days.

(21) Appl. No.: 13/030,942

(22) Filed: Feb. 18, 2011

(65) Prior Publication Data

US 2011/0205136 A1 Aug. 25, 2011

Related U.S. Application Data

(60) Provisional application No. 61/306,815, filed on Feb. 22, 2010.

(51) Int. Cl.
*H01Q 13/02* (2006.01)
*H01P 1/17* (2006.01)
*H01Q 21/06* (2006.01)

(52) U.S. Cl.
USPC ..... 343/786; 343/756; 343/772

(58) Field of Classification Search
CPC ..... H01Q 13/0216; H01Q 13/0258
USPC ..... 343/786
See application file for complete search history.

(56) References Cited

U.S. PATENT DOCUMENTS 4,122,446 A 10/1978 Hansen
4,258,366 A 3/1981 Frosch et al.
4,442,437 A 4/1984 Chu et al.
5,486,839 A 1/1996 Rodeffer et al.
6,005,528 A 12/1999 Preiss et al.
6,208,309 B1 * 3/2001 Chandler et al. ..... 343/786
6,396,453 B2 5/2002 Amyotte et al.

(Continued)

FOREIGN PATENT DOCUMENTS

EP 1158597 11/2001
WO WO 96/04692 2/1996

(Continued)

OTHER PUBLICATIONS

Du et al., Restraint of Unwanted Higher-Order Modes in Wideband Tracking Corrugated Horn, Electronics Letters, IEE Stevenage, GB, vol. 36, No. 6, Mar. 16, 2000, pp. 490-491.

(Continued)

*Primary Examiner* — Dameon E Levi
*Assistant Examiner* — Ricardo Magallanes
(74) *Attorney, Agent, or Firm* — Snell & Wilmer L.L.P.

(57) ABSTRACT

A feed horn and systems and methods of making and using the feed horn are presented. Exemplary feed horns include a first portion comprising a dual mode geometry and a second portion comprising an axial corrugation geometry. The feed horn may operate simultaneously in a plurality of separate frequency bands (e.g., from about 18.3 GHz to about 20.2 GHz and from about 29.1 GHz to about 30.0 GHz) and a plurality of separate waveguide modes (e.g., $TE_{11}$, $TM_{11}$ or $HE_{11}$ modes); simultaneously operating over two bandwidth segments of at least 1900 MHz that are separated by at least 5000 MHz. The feed horn may have a short axial length (e.g. less than 4 wavelengths at 18.3 GHz), and it may be configured to operate in a prime fed offset reflector antenna system. In addition, the feed horn may be formed as a single piece via a single casting pull.

24 Claims, 11 Drawing Sheets

(56) References Cited

U.S. PATENT DOCUMENTS

| | | | | |
|---|---|---|---|---|
| 6,441,793 | B1 | 8/2002 | Shea | |
| 6,535,169 | B2 | 3/2003 | Fourdeux et al. | |
| 6,700,548 | B1 | 3/2004 | Chen et al. | |
| 6,714,165 | B2 | 3/2004 | Verstraeten | |
| 6,720,933 | B2 | 4/2004 | Hanlin et al. | |
| 6,943,744 | B1 | 9/2005 | Vezmar | |
| 7,002,528 | B2 | 2/2006 | Moheb | |
| 7,167,138 | B2 | 1/2007 | Eom et al. | |
| 7,439,925 | B2 | 10/2008 | Huang et al. | |
| 2002/0000945 | A1 | 1/2002 | Amyotte et al. | |
| 2005/0104794 | A1 * | 5/2005 | Rao et al. | 343/786 |
| 2006/0189273 | A1 | 8/2006 | Buer et al. | |
| 2009/0009404 | A1 | 1/2009 | Buer et al. | |
| 2009/0109111 | A1 * | 4/2009 | McGonigle et al. | 343/786 |
| 2009/0309801 | A1 | 12/2009 | Rao et al. | |

FOREIGN PATENT DOCUMENTS

| | | |
|---|---|---|
| WO | 2006091276 | 8/2006 |
| WO | 2006127610 | 11/2006 |
| WO | 2006127612 | 11/2006 |
| WO | 2007064094 | 6/2007 |

OTHER PUBLICATIONS

European Search Report, European Application No. EP 11155273.3, dated May 27, 2011.

Mician GmbH "Horn Antenna Synthesis CAD Tool," Micrwave Journal, 2008 (4 pages).

Exam Report dated Jul. 12, 2013 in European Application No. 11155273.3.

Yueh-Chi Chang; Hanlin, J., "Commercial Ka and Ku bands reflector antennas", Antennas and Propagation International Symposium, 2007 IEEE, vol. , Issue , Jun. 9-15, 2007 pp. 5175-5178.

Dubrovka F. F., et al., "Recent Progress in Development of Multiband Feed Horns (Review)", International Conference on Antenna Theory and Techniques, Sep. 17-21, 2007, pp. 44-50, Ukraine.

Skyttemyr, "Ka/Ku-Band Antennas for Return Channel over Satellite", Dec. 8, 2000, pp. 1-51.

Skyttemyr, et al., Feed Horns and Reflector Antennas for Ka/Ku-Band Operation, Feb. 27, 2001, pp. 1-19.

Creticos, et al., "A Compact Ku/Ka Band Feed", Antennas and Propagation Society International Symposium, Jun. 9-15, 2007, pp. 3237-3240, Amherst, Massachusetts.

Yun, et al., Ku/Ka band Fee Assembly for the CBS Antenna Subsystem, 3rd ETRI-CRL Joint Conference, Nov. 5-6, 2002, Daejon, Korea, pp. 51-54.

Han, et al., "Simulation and Electrical Design of the offset dual reflector antenna with Conical Beam Scanning", Antennas and Propagation Society International Symposium, Jun. 9-15, 2007, pp. 845-848.

Yun, et al., "Four Band Feed System with Electrical Tracking Capability for Ku/Ka Band Bi-directional Antenna", Antennas and Propagation Society International Symposium, Jul. 5-11, 2008, 4 pages.

Eom, et al., "Design and Test of a Mobile Antenna System with Tri-Band Operation for Broadband Satellite Communications and DBS Reception", IEEE Transactions on Antennas and Propagation, vol. 55, No. 11, Nov. 2007, pp. 3123-3133.

Fikart, "Outdoor Units for Ka/Ku-Bands Satellite Interactive Terminals", 2001, pp. 1141-1144, Burnaby, Canada.

Davoli, et al., "A Ka/Ku Band Integrated Satellite Network Platform for Experimental Measurements and Services: The CNIT Experience", in Proceedings of the 11th Ka and Broadband Utilization Conference, 9 pages, Rome, Italy, Sep. 2005.

Thiart, "A Dual-Band and Dual-Polarization Feed-Multiplexer for Ku/Ka-Band Operation", 2005, 9ages 1-118, University of Victoria.

Thiart, et al., "Prototype design of a dual-band dual-polarization Ku/Ka-band feed", Proceedings of the European Microwave Association, vol. 2, Dec. 2006, pp. 318-325.

Trajkovic, "Ka-Band Transmitter for IP Transfer over Satellite", 2002, pp. 1-74, Simon Fraser University.

* cited by examiner

SYSTEM AND METHOD FOR HYBRID GEOMETRY FEED HORN

CROSS-REFERENCE TO RELATED APPLICATION

This application is a non-provisional application which claims priority to U.S. Provisional Application Ser. No. 61/306,815, filed Feb. 22, 2010, which is incorporated herein by reference.

FIELD OF INVENTION

The application relates to systems, devices, and methods for conveying radio waves. More particularly, the application relates to a hybrid horn antenna system configured to communicate over a wide frequency bandwidth and configured to accept multiple separate frequencies and multiple separate modes, where the hybrid horn antenna may be fabricated using low costs methods such as casting.

BACKGROUND OF THE INVENTION

A feed horn may convey radio frequency signals to/from a remote location (such as a satellite). Historically, high performance simultaneous multiple low and high frequency, dual mode, feed horn communication has not been possible within a single feed horn that may be fabricated using low cost methods such as conventional single-piece casting. Conventional single-piece casting has often imposed design constraints that have discouraged the use of such techniques for feed horns of the type discussed above. Additionally, conventional feed horn assemblies suitable for single-piece casting have not been able to communicate using HE mode, TE mode and/or TM mode over wide bandwidths.

In the past, feed horns have not been made that are small (short axial length) but that also have a large bandwidth, with low cross-polarization, with nearly E- and H-plane symmetric patterns, and that can be cast as a single piece using conventional fabrication techniques. The need for nearly symmetric cardinal plane patterns with low cross-polarization occurs for efficient operation of prime fed offset reflector antenna systems. For example, it is believed that it is not possible to make a smooth wall Ka-Band feed horn with solely a dual mode architecture that can operate over two frequency bandwidth segments of at least 1900 MHz having a band separation of 7900 MHz between high and low band segments with an axial length of less than 3 inches. Similarly, it is believed that it is not possible to fabricate a low cost Ka-Band feed horn with solely a corrugated architecture that can operate over two frequency bandwidth segments of at least 1900 MHz having a band separation of 7900 MHz between high and low band segments with an axial length of less than 3 inches.

Additionally, conventional feed horn assemblies have multiple pieces that are assembled post fabrication which often leads to unwanted losses and tedious dimensional tolerance concerns at high frequency operation. Moreover, between the coupling of each individual piece a new potential for error may be introduced. Thus, a need exists for improved feed horn systems, methods and devices for addressing these and other issues.

SUMMARY OF THE INVENTION

In accordance with various aspects of the present invention, a device, system and method related to a hybrid geometry feed horn is presented. In one exemplary embodiment, a hybrid geometry feed horn includes a first portion of the feed horn comprising a dual mode geometry and a second portion of the feed horn comprising an axial corrugation geometry. In one exemplary embodiment the feed horn is configured to operate in a plurality of separate frequency bands and a plurality of separate waveguide modes. For instance, in one exemplary embodiment, the first frequency range or band segment may be from about 18.3 GHz to about 20.2 GHz and the second frequency range or band segment may be from about 29.1 GHz to about 30.0 GHz. In one exemplary embodiment, the feed horn may simultaneously operate over two bandwidth segments of at least 1900 MHz and separated by at least 5000 MHz. The separate wave guide modes include one or more of $TE_{11}$ mode, $TM_{11}$ mode or $HE_{11}$ mode.

In an exemplary embodiment, the feed horn has a short axial length, such as less than 4 wavelengths at 18.3 GHz, and has a low cross-polarization, with nearly E- and H-plane symmetric patterns. The feed horn may be configured to operate in a prime fed offset reflector antenna system. In addition, the feed horn may be formed as a single piece via a single casting pull.

Methods of using and forming the feed horn are further described herein.

BRIEF DESCRIPTION OF THE DRAWING FIGURES

A more complete understanding of the present invention may be derived by referring to the detailed description, statements and the claims when considered in connection with the drawing figures, wherein like reference numbers refer to similar elements throughout the drawing figures, and:

DETAILED DESCRIPTION

While exemplary embodiments are described herein in sufficient detail to enable those skilled in the art to practice the invention, it should be understood that other embodiments may be realized and that logical electrical and mechanical changes may be made without departing from the spirit and scope of the invention. Thus, the following detailed description is presented for purposes of illustration only.

In accordance with an exemplary embodiment of the present invention, a hybrid feed horn is formed by combining at least some features from both a dual mode geometry feed horn and at least some features from an axial type corrugation geometry feed horn. The hybrid feed horn may be fabricated using low cost methods such as conventional single-piece casting. This monolithic construction may facilitate lower losses as well as facilitate construction by reducing dimensional tolerance issues. In an exemplary embodiment, the hybrid feed horn may have a short axial length. For example, a length of less than 3 inches.

In an exemplary embodiment, the hybrid feed horn may be configured to communicate using HE mode, TE mode and/or TM mode. In an exemplary embodiment, the hybrid feed horn may be configured to communicate over wide bandwidths. For example, the hybrid horn may operate over two frequency bandwidth segments of at least 1900 MHz having a band separation of 7900 MHz. In an exemplary embodiment, the hybrid feed horn may function at relevant frequencies with low cross-polarization and nearly symmetric E-plane and H-plane patterns.

These exemplary features and elements may be combined, and in various exemplary embodiments, a single hybrid feed horn may comprise some or all of these features. For example, a short, single piece cast hybrid feed horn may be configured to support high performance simultaneous multiple low and high frequency, dual mode, feed horn communication. Further details and examples are provided below, and the term "feed horn" is used interchangeably with the term "hybrid feed horn".

Figure 1A:
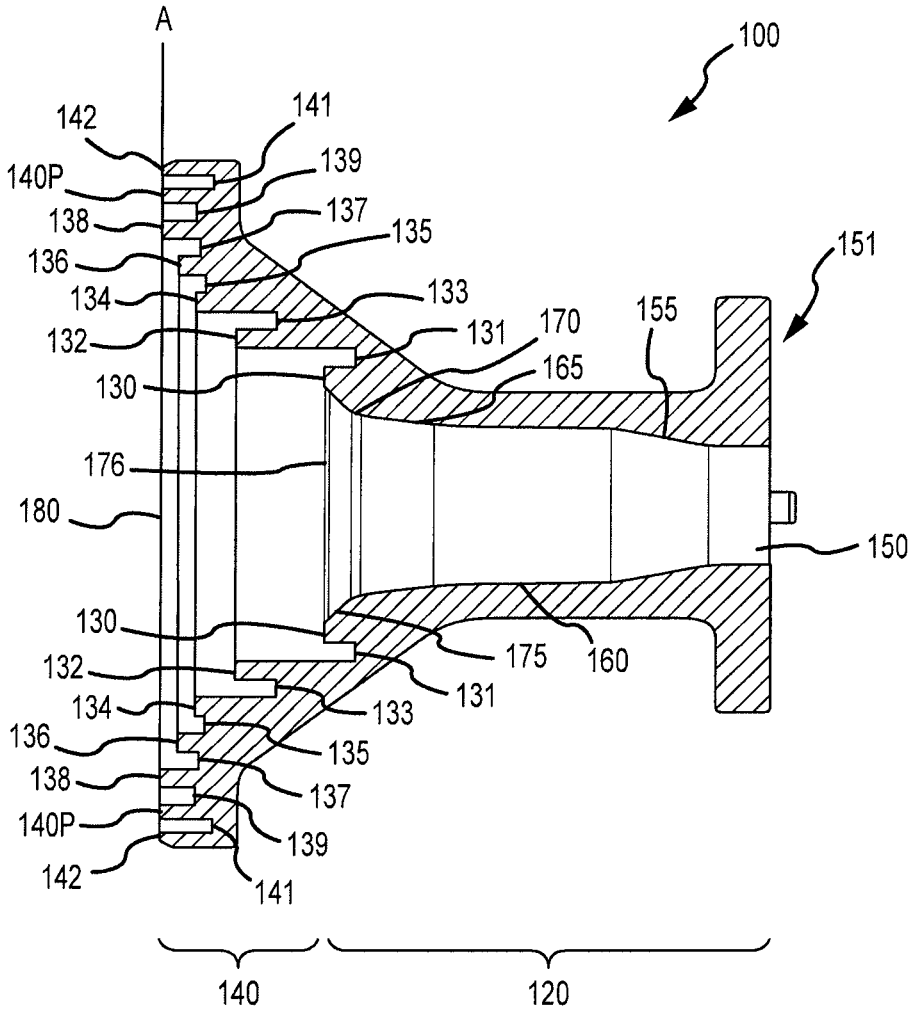
FIG. 1A illustrates a front view of an exemplary feed horn, in accordance with an exemplary embodiment.
Figure 1B:
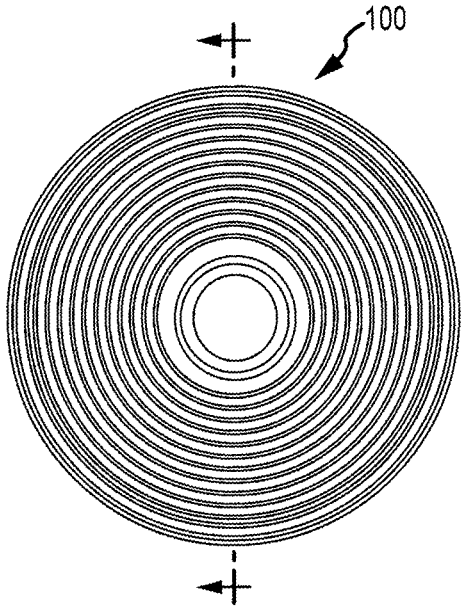
FIG. 1B illustrates a cross-sectional view of the exemplary feed horn depicted in FIG. 1A.
Figure 1C:
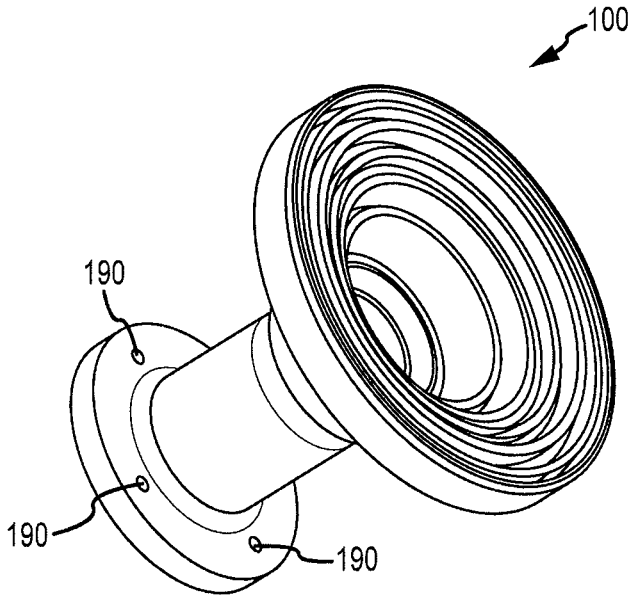
FIG. 1C illustrates a perspective view of the exemplary feed horn depicted in FIGS. 1A and 1B.

In accordance with an exemplary embodiment of the present invention and with reference to FIGS. 1A thru 1C, a feed horn 100 comprises a first portion 120 and a second portion 140. In one exemplary embodiment, first portion 120 of the feed horn comprises a dual mode geometry. In one exemplary embodiment, second portion 140 of the feed horn comprises an axial type corrugation geometry. In one exemplary embodiment, feed horn 100 is configured to communicate in a plurality of separate frequency bands. In one exemplary embodiment, feed horn 100 is configured to communicate in a plurality of separate modes (also described herein as "waveguide modes").

In one exemplary embodiment, feed horn 100 is configured to operate predominately as an axial corrugated horn (and/or to a lesser extent as a dual mode horn) at a first frequency range or band segment and feed horn 100 is configured to operate predominately as a dual mode horn (and/or to a lesser extent as an axial corrugated horn) at a second frequency range or band segment. In one exemplary embodiment, the first frequency range may be from about 18.3 GHz to about 20.2 GHz (i.e. a bandwidth of 1.9 GHz). The second frequency range may be from about 28.1 GHz to about 30.0 GHz (i.e. a bandwidth of 1.9 GHz).

In another exemplary embodiment, the first frequency range may be from about 17.7 GHz to about 20.2 GHz (i.e. a bandwidth of 2.5 GHz). In this exemplary embodiment, the second frequency range may be from about 27.5 GHz to about 30.0 GHz (i.e. a bandwidth of 2.5 GHz).

In yet another exemplary embodiment, the first frequency range may be from about 20.2 GHz to about 21.2 GHz (a bandwidth of 1 GHz). In this exemplary embodiment, the second frequency range may be from about 30 GHz to about 31.0 GHz (i.e. a bandwidth of 1 GHz).

In yet another exemplary embodiment, the first frequency range may be from about 17.7 GHz to about 21.2 GHz (a bandwidth of 3.5 GHz). In this exemplary embodiment, the second frequency range may be from about 27.5 GHz to about 31.0 GHz (i.e. a bandwidth of 3.5 GHz).

In one exemplary embodiment, feed horn 100 is coupled to a low-noise block converter LNB (not shown). In another exemplary embodiment, feed horn 100 is coupled to a transceiver. Furthermore, in an exemplary embodiment, feed horn 100 may be coupled to a transceiver that may include both a LNA and SSPA and frequency conversion devices and may operationally interface to a modem at an intermediate frequency (IF). In various exemplary embodiments, however, feed horn 100 includes an integrated LNB.

Figure 7:
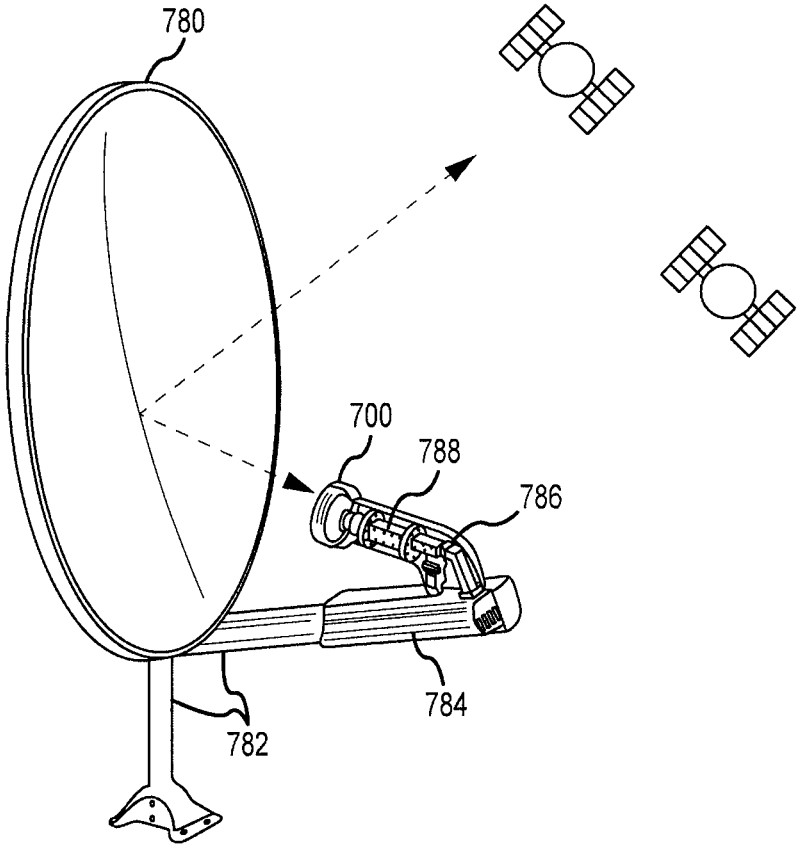
FIG. 7 illustrates a feed horn coupled between a transceiver and a reflector in accordance with one exemplary embodiment.

With reference to FIG. 7, an exemplary feed horn 700 may further be configured to communicate RF signals with a remote system. For example, feed horn 700 may be configured to communicate with a satellite. Moreover, in an exemplary embodiment, feed horn 700 communicates with a satellite via a reflector dish 780 proximate to feed horn 700. In one exemplary embodiment, feed horn 700 is configured to work with prime fed offset reflector systems.

In another exemplary embodiment, feed horn 700 may be connected to and/or supported by another device and/or structure. For example, feed horn 700 may be connected to a transceiver 784. Feed horn 700 may be connected to transceiver 784 via a polarizer 788 and/or via an OMT 786. In other exemplary embodiments, OMT 786 and/or polarizer 788 may be integral to transceiver 784. In that particular exemplary embodiment, feed horn 100 may be directly attached to transceiver 784. In yet another exemplary embodiment, feed horn 100 is also integral to a transceiver.

In another exemplary embodiment, the feed horn may be integral to a polarizer. In this embodiment, the feed horn may be split (upon its axis) and molded with a polarizer as a monolithic system.

Figure 4B:
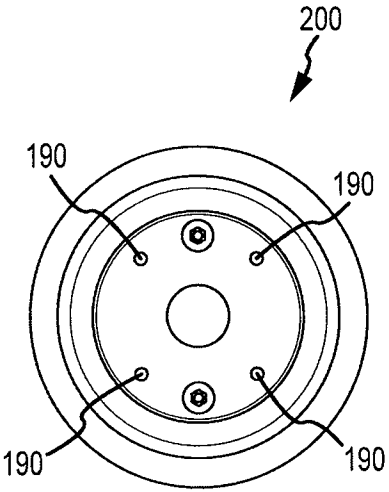
FIGS. 4A and 4B illustrate exterior views of an exemplary feed horn, in accordance with an exemplary embodiment.
Figure 4A:
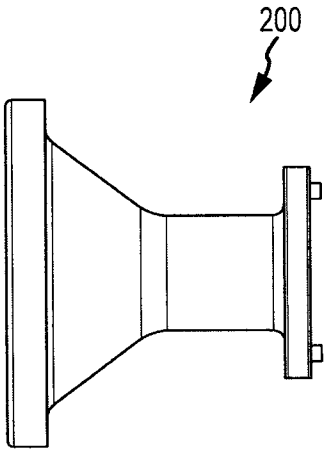

In an exemplary embodiment, feed horn 700 may be coupled to additional antenna structures such as a structural support, and/or antenna optics. With renewed reference to FIGS. 1C, 4A and 4B, the coupling of feed horn 100 to a structural support 782, other component, and/or antenna optics may be accomplished using threaded fasteners and through holes 190 in the flanged exterior of first portion 120. In other exemplary embodiments, this coupling may be accomplished through any suitable coupler such as by way of adhesive, hooks, snaps, latches, screws, or other mechanisms as would be well known to one skilled in the art.

With reference again to FIGS. 1A and 1B, feed horn 100 comprises a solid structure with a hollow interior of geometry and shape suitably formed as described herein to transmit and/or receive radio frequency signals. In an exemplary embodiment feed horn 100 is generally symmetrical in shape with a circular hollow interior. The hollow interior may be described, for example, with reference to various inner diameter measurements at various locations along the axis if feed horn 100.

Portions and/or all of feed horn 100 may be made from any suitable material, such as zinc or aluminum. In another exemplary embodiment, feed horn 100 may be made from a dielectric or conducting polymer, such as an electropolymer. Alternatively, in another exemplary embodiment, feed horn 100 may be made from a plastic coated with metal, such as copper and nickel. Use of zinc may facilitate achieving specific fabrication tolerances and low tool wear during molding. Use of aluminum may result in a light weight structure and higher tool wear than zinc.

In one exemplary embodiment, feed horn 100 and/or portions of feed horn 100 are configured to be manufactured via die casting. In one exemplary embodiment, feed horn 100 is configured to be fabricated with a single casting pull. In one exemplary embodiment, this single casting pull reduces costs and time of fabrication. The geometry of feed horn 100, in accordance with one exemplary embodiment, is designed to accommodate this single casting pull. In this exemplary embodiment, the geometry of feed horn 100 suitably uses selected draft angles to facilitate single pull casting. Also, axial type corrugations are used and the geometry of the feed horn 100 is limited in this exemplary embodiment to types that allow a single pull casting. All known or newly discovered casting techniques, may be used to facilitate such casting of feed horn 100. In an exemplary embodiment, elements of the system are configured to have smooth edges to improve dimensional tolerance and mold separation during manufacture via die casting.

In another exemplary embodiment, feed horn 100 and/or portions of feed horn 100 are configured to be fabricated by one of injection molding, metal injection molding, plastic injection molding, pressed powder sintering, turning and/or machining.

In an exemplary embodiment, feed horn 100 may be formed as a single piece structure. In other embodiments, however, feed horn 100 could be made as more than one component which are coupled together to form feed horn 100. That said, however, in accordance with an exemplary embodiment of the present invention, feed horn 100 is a monolithic, single piece structure. Nevertheless, this unitary structure may be thought of as having two distinct portions, such as the first and second portions described herein.

In an exemplary embodiment, first portion 120 comprises a circular cross section that changes at various points along the axial direction of feed horn 100. The circular cross section is the inner diameter of a waveguide channel within feed horn 100. This inner diameter generally gets larger as position changes along the axis of feed horn 100 in a direction from the base of feed horn 100 towards the aperture of feed horn 100 ("in a forward direction"). The inner diameter may be constant over some portions of the length of feed horn 100, and over other portions of the length of feed horn 100 the inner diameter may increase linearly. In one exemplary embodiment, the inner diameter has at least a small draft angle along the entire length of portion 120. Feed horn 100 may be so configured with at least a minimum draft to facilitate a single die cast pull in the manufacture of feed horn 100. Feed horn 100 may have any suitable outside diameter, but in a first exemplary embodiment, feed horn 100 has an outside diameter of 3", and in second exemplary embodiment, feed horn 100 has an outside diameter of 2.78" with both measured at the aperture.

In another embodiment, the rate of change of the inner diameter, or abrupt changes in the rate of change of the inner diameter between sections assists with the function of feed horn 100. For instance, in one exemplary embodiment, the gradual change may assist the impedance mismatch and abrupt changes may assist in the launching of the RF signal and or in the propagation of waveguide modes of the system.

Moreover, for convenience in describing the structure of feed horn 100 at various locations within each of the first and second portions, the first and second portions will be further described in terms of sections which further subdivide the unitary feed horn 100. In one exemplary embodiment and with renewed reference to FIGS. 1A thru 1C, first portion 120 is segmented into any suitable number of sections representing segments of first portion 120 in the axial direction. Each section may have a predetermined length and a predetermined taper angle and/or draft. Though sections may be any suitable shape, in one exemplary embodiment, the plurality of sections are cylindrical or conical in nature.

In one exemplary embodiment, first portion 120 of feed horn 100 may have a plurality of sections. In one exemplary embodiment, first portion 120 includes 7 sections 150, 155, 160, 165, 170, 175, 176. Any suitable number of sections may be used. In general with reference to FIG. 1A, in one exemplary embodiment, the inner diameter of first portion 120 is larger near the intersection of first and second portions 120/140 than it is at the base (or flange) 151 of feed horn 100. For instance, in one embodiment, the diameter of first portion 120 spans from about 0.517 inches to about 0.993 inches. However, other dimensions for the feed horn diameters in first portion 120 may be used.

Figure 3:
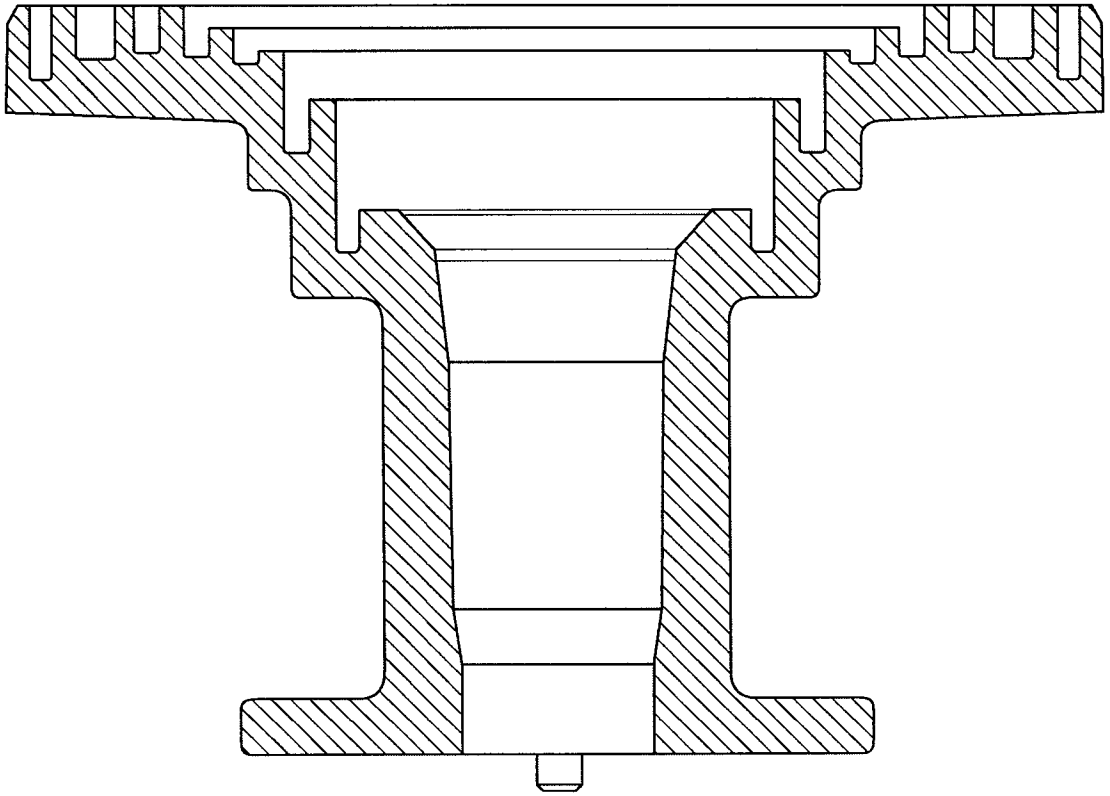
FIG. 3 illustrates a cross-sectional profile view of another exemplary feed horn, in accordance with an exemplary embodiment.

For example, in one exemplary embodiment, the inner diameter of the first through seventh segments of first portion 120 (as measured at the edge nearest the next segment) are: 0.517", 0.645", 0.669", 0.742", 0.754", 0.958", and 0.993" respectively. With momentary reference to FIG. 3, in another exemplary embodiment, the inner diameter of the first through seventh segments of first portion 120 (as measured at the edge nearest the next segment) are: 0.518", 0.564", 0.585", 0.649", 0.659", 0.838", and 0.868" respectively. It is also noted that in one exemplary embodiment, the first section can be post machined as a straight section with a 0.517" inner diameter. In another exemplary embodiment, this first section 150 is formed via casting and has a draft angle as well.

Each of the seven sections 150, 155, 160, 165, 170, 175, 176 may have a length. For instance, first portion 120 section length may be measured from a point where a change in draft occurs to the next point where a change in draft occurs. In one exemplary embodiment, the length of one section of first portion 120 may be a different length or the same length than that of another first portion 120 section. In one embodiment, points where draft changes occur (above a certain threshold) facilitate impedance matching of the modes and if the changes are large enough one or more additional modes may be launched.

Figure 2:
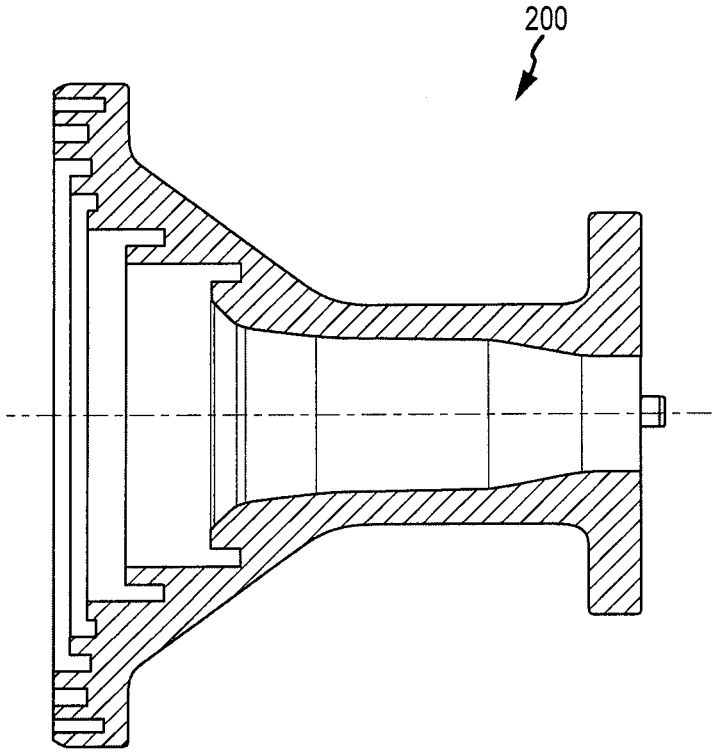
FIG. 2 illustrates a cross-sectional profile view of an exemplary feed horn, in accordance with an exemplary embodiment.

For instance, in one exemplary embodiment with reference to FIG. 2, first section 150 of feed horn 200 may have a length about 0.25 inches, second section 155 may have a length of about 0.398 inches, third section 160 may have a length of about 0.737 inches, fourth section 165 may have a length of about 0.305 inches, fifth section 170 may have a length of about 0.011 inches, sixth section 175 may have a length of about 0.023 inches, and seventh section 176 may have a length of about 0.009 inches. Moreover, any other suitable lengths may be used for the various sections in first portion 120. For example, and with momentary reference to FIG. 3, as measured from flange 151, the first through seventh sections in the second exemplary embodiment may comprise lengths of: 0.25, 0.40, 1.077, 1.356, 1.388, 1.485, and 1.493 inches respectively.

In one exemplary embodiment, sections 150, 155, 160, 165, 170, 175, 176 may have different and/or no draft(s). In one embodiment, with reference to FIG. 1, if a section has a draft, the diameter of the side closer to reference plane A may be larger than the diameter of the side farther from reference plane A. For example, section 160 may be referred to herein as a phasing section (see below). Also, section 175 may be particularly helpful in launching the high frequency signal.

Although dimensions are recited herein for one exemplary hybrid feed horn, it should be understood that similar hybrid feed horns can be constructed with different dimensions. The dimensions are selected in an exemplary embodiment, through use of computer optimization techniques utilizing desired boundary conditions.

In an exemplary embodiment, second portion 140 is adjacent to first portion 120, and both are integrally part of feed horn 100. In one exemplary embodiment with renewed reference to FIG. 1A, second portion 140 may comprise protrusions in the axial direction and may include at least one protrusion surface. For instance, in one exemplary embodiment second portion 140 comprises 7 protrusion surfaces. Furthermore, any suitable number of protrusion surfaces may be used.

Second portion 140 protrusion surfaces may be located a predetermined distance from a reference plane, such as reference plane A. In one exemplary embodiment, plane A is 2.511 inches from the base flange. In a second exemplary embodiment, plane A is 2.049 inches from the base flange. Other total feed horn lengths may also be used. In one exemplary embodiment having seven protrusions (not counting the outer edge of the feed horn), the distances (listed in order from the inner protrusion to the outer ones) of the protrusions from the reference plane. A at the aperture of the feed horn are: 0.672", 0.309", 0.15", 0.075", 0", 0", and 0" respectively. In another exemplary embodiment, and with momentary reference to FIG. 3, these measurements are: 0.556", 0.256", 0.124", 0.062", 0", 0", and 0" respectively. Furthermore, any suitable height of protrusion may be used.

Also, each protrusion surface may be any suitable width. In one exemplary embodiment, multiple individual protrusion surfaces (such as protrusion surfaces 130, 132, 134, 136, 138, 140P, 142) may comprise substantially the same width. In another exemplary embodiment, some or all of multiple individual protrusion surfaces comprise a different width from other multiple individual protrusion surfaces. For example, the protrusion surface may have a width of 0.145", or any other suitable width(s).

In one exemplary embodiment, the individual protrusion surfaces (such as protrusion surfaces 130, 132, 134, 136, 138, 140P, 142) may comprise any suitable topology and/or orientation with respect to reference plane A. For instance, the individual protrusion surfaces (such as protrusion surfaces 130, 132, 134, 136, 138, 140P, 142) may be parallel to reference plane A or may be offset any suitable angle between 1 and 90 degrees in either direction from reference plane A. Stated another way, each protrusion may be thought of as a "tooth" having a top surface that could be flat (parallel with reference plane A) or may have a bevel(s).

In another exemplary embodiment, the protrusion surfaces (e.g. protrusion surfaces 130, 132, 134, 136, 138, 140P, 142) may be textured. For instance, protrusion surfaces may be dimpled, rough, recessed, smooth, and or the like. In one exemplary embodiment, these surface textures may facilitate conversion of the RF signal from one mode to another mode (e.g. $TE_{11}$ mode into $TM_{11}$ mode). In various exemplary embodiments, a protrusion surface (such as protrusion surfaces 130, 132, 134, 136, 138, 140P, 142) may be a substantially uniform distance from reference plane A or the distance from a reference plane A may be varied over each individual protrusion surface (such as protrusion surfaces 130, 132, 134, 136, 138, 140P, 142).

In yet another exemplary embodiment, feed horn 100 may be formed such that the aperture of feed horn 100 is other than perpendicular from the central axis of the feed horn. This embodiment is not shown in the figures, but would look similar, however with the aperture cut off at an angle that is not perpendicular to the axis of the feed horn. Such a feed horn may facilitate steering (e.g. squinting) of one or more beams.

In one exemplary embodiment, each individual protrusion surface (such as protrusion surfaces 130, 132, 134, 136, 138, 140P, 142) may comprise any suitable geometric shape, such as substantially circular, and/or substantially elliptical about the axis of feed horn 100. In general, the shape of each protrusion surface (such as protrusion surfaces 130, 132, 134, 136, 138, 140P, 142) may match the shape and/or beam characteristics of a provided main reflector (or other optic components feed horn 100 is mated with).

Furthermore, second portion 140 may comprise at least one or more grooves set into feed horn 100 in the axial direction with a groove opening in the direction of reference plane A. The bottom of such a grove comprises a groove surface. In one exemplary embodiment with renewed reference to FIG. 1A, second portion 140 includes at least one groove surface associated with a groove and located a predetermined distance from a reference plane, such as reference plane A. For instance, feed horn 100 may comprise six groove surfaces, 131, 133, 135, 137, 139, and 141. With reference to FIG. 1B, a groove surface may form a circle. In other exemplary embodiments, a groove surface may form an ellipse.

With continued reference to FIG. 1B, each groove surface may be located between two protrusion surfaces. Each groove surface may be any suitable width. For example, a groove surface (or the distance between protrusions) may have a width of 0.145" or any other suitable width. Moreover, multiple individual groove surfaces may comprise substantially the same or different widths.

In addition, the groove surfaces may have a depth that may be described in terms of the offset of the groove surface from the reference plane A. With reference to FIG. 2, in one exemplary embodiment having six grooves, the distances (listed in order from the inner groove to the outer ones) of the groove surface from the reference plane A at the aperture of the feed horn are: 0.809", 0.483", 0.192", 0.169", 0.156", and 0.225" respectively. With momentary reference to FIG. 3, in another exemplary 7 groove embodiment, these measurements are: 0.67", 0.399", 0.159", 0.141", 0.129", 0.146", and 0.203", respectively. Furthermore, any suitable depth of groove may be used.

In accordance with an exemplary embodiment, second portion 140 is a corrugated portion. This corrugated portion may, in an exemplary embodiment and as illustrated for example in FIGS. 2 and 3, have substantially continuous corrugations over the entire region from the dual mode section to the aperture. Stated another way, second portion 140 may have evenly distributed protrusions and grooves over the entire region of second portion 140. Stated yet another way, the density of corrugations is about the same over the region from the interface with the dual mode section to the aperture of the feed horn. In another exemplary embodiment, the widths of successive protrusions and the widths of successive grooves, respectively, are about the same or at least within 25% of each other. This is to say that, in an exemplary embodiment, the feed horn corrugation section does not have just two or three corrugations that are widely spaced apart.

Similar to the protrusion surfaces, in one exemplary embodiment, the individual groove surfaces may comprise any suitable topology and/or orientation with respect to reference plane A. For instance, the individual groove surface may be parallel to reference plane A. Stated another way, groove surfaces (such as groove surfaces 131, 133, 135, 137, 139, 141) may be perpendicular to the central axis of the feed horn 100. In another exemplary embodiment, the groove surface may be offset any suitable angle from reference plane A. In other words the bottom of the trench could be flat, slanted at an angle, or have some other shape.

In an exemplary embodiment, the groove surface may be textured. Furthermore, the entirety of a particular groove surface may be a substantially uniform distance from reference plane A or the distance from a reference plane A may be varied over some or all of the groove surface.

The side walls of each groove may be a uniform length or the side wall length may vary. Also, in one embodiment, the grooves associated with groove surfaces (such as grooves associated with groove surfaces 131, 133, 135, 137, 139, 141) may be parallel to the central axis of the feed horn 100.

Figure 1D:
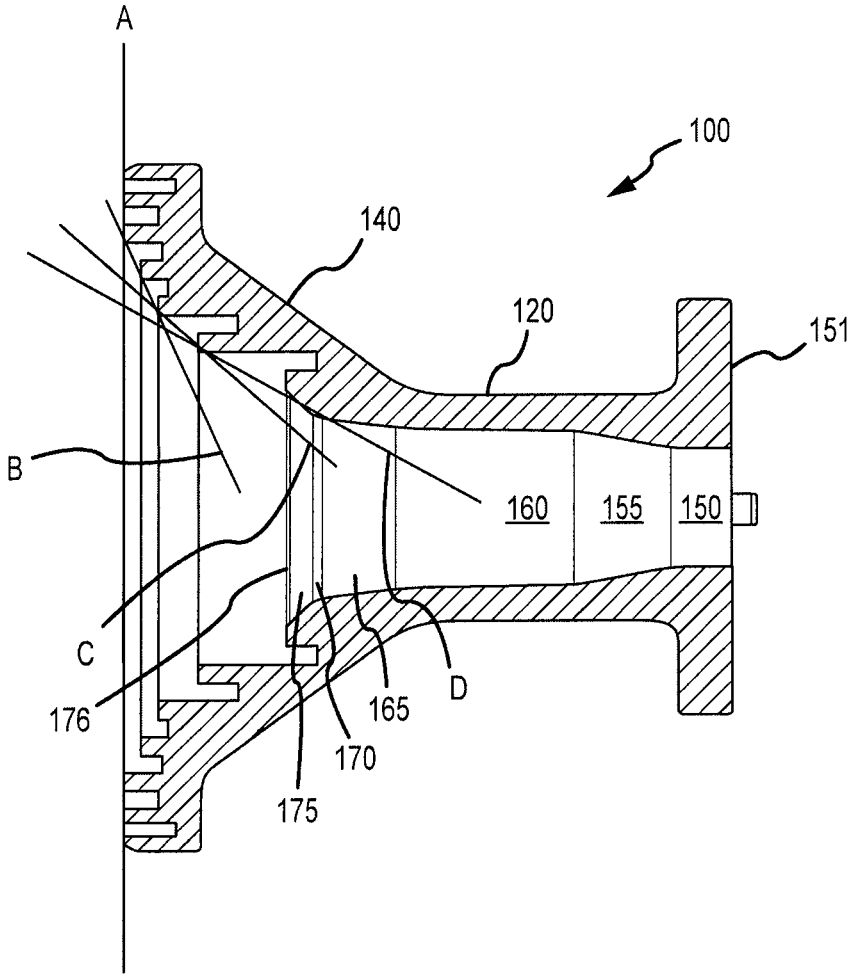
FIG. 1D illustrates the flare angles of the exemplary feed horn depicted in FIGS. 1A thru 1C.

In one exemplary embodiment and with reference to FIG. 1D, feed horn 100 may be characterized in terms of flare angles. In first portion 120, feed horn 100 comprises a first flare angle at section 155. This flare angle is the angle of the wall of the waveguide in this section relative to the axis of the waive guide for feed horn 100. Another flare angle exists at section 165, and yet another flare angle exists at section 175.

Moreover, in second portion 140, a flare angle may be characterized by drawing a line from the inner most point of one protrusion surface to the innermost point of an adjacent protrusion surface. Thus, continuing the progression of description of flare angles from base 151 toward the aperture of the feed horn: flare angle D touches an innermost corner of a protrusion near section 175/170 and the other at the next protrusion corner; flare angle C spans from there to the next protrusion, and flare angle B spans from there to the next protrusion. This may continue for as many flare angles as available until the flare angle is 90 degrees (perpendicular to the axis of the feed horn in the non-squint embodiments).

Stated another way, in one exemplary embodiment, the intersection of a protrusion surface 130, 132, 134, 136, 138, 140P, 142 with a side wall associated with that protrusion surface will typically generate two points (one for each side wall). If the point closest to the longitudinal axis of feed horn 100 is selected for each protrusion and a line is drawn from one such point to a corresponding point on the next protrusion—that line represents a flare angle. Lines B, C, and D, each connect a successive pair of innermost points on protrusion surfaces and each comprise flare angles for feed horn 100.

In accordance with an exemplary embodiment, the flare angles increase successively from base 151 to the aperture of feed horn 100. It will be understood, then, that in an exemplary embodiment, the flare angle may increase from nearly 0 degrees to nearly 90 degrees. In this manner, feed horn 100 is configured to reduce the amount of signal reflected back and to efficiently launch the transmit signal(s).

In one exemplary embodiment and with reference to FIGS. 1C, 3, 4A and 4B, the exterior surface of feed horn 100 may comprise any suitable shape. In one exemplary embodiment, the exterior surface of feed horn 100 comprises smooth corners to assist with injection molding techniques. In some exemplary embodiments, uniform thickness of structures is utilized to assist with injection molding techniques. In one exemplary embodiment, referring to FIG. 1A, the thickness of portions and/or structures of feed horn 100 is not uniform.

In an exemplary embodiment, the segments of first portion 120 and second portion 140 comprise a waveguide (or portions of a waveguide). Stated another way, the interior surfaces of feed horn 100 comprises a waveguide. A transverse mode of a beam of electromagnetic radiation is a particular electromagnetic field pattern of radiation measured in a plane perpendicular (i.e. transverse) to the propagation direction of the beam. Transverse modes may occur in radio waves and microwaves confined to a waveguide. Transverse modes may occur because of boundary conditions imposed on the wave by the waveguide. For this reason, the modes supported by a waveguide are quantized. The allowed modes can be found by solving Maxwell's equations for the boundary conditions of a given waveguide. Transverse modes are generally classified into different types: Transverse Electric (TE), Transverse Magnetic (TM), Transverse Electromagnetic (TEM) modes and Hybrid modes (HE). TE mode does not have an electric field in the direction of propagation. TM mode does not have a magnetic field in the direction of propagation. TEM mode does not have electric or magnetic fields in the direction of propagation. Hybrid modes may have a nonzero electric field and a nonzero magnetic field in the direction of propagation.

By selecting the diameter, length and number of sections (such as sections 150, 155, 160, 165, 170, 175, 176) of the first portion 120, feed horn 100 is configured to respond to electromagnetic signals of different frequency bands at different phases and modes separately at the same time. The separate frequency bands may include one or more of the C band, X band, Ku band, K band, Ka band, Q band, W band or V band. Although exemplary dimensions are set forth in connection with FIGS. 2 and 3, it will be appreciated that other dimensions may be employed to accommodate various separate frequency bands (one or more of the C band, X band, Ku band, K band, Ka band, Q band, W band or V band) based on the principles disclosed herein.

The separate waveguide modes may include any modes. These modes may include one or more of $TE_{11}$ mode, $TM_{11}$ mode, and $HE_{11}$ mode among other known modes. In general, multiple sections of feed horn 100 participate in the manipulation of the various modes, however, section 120 is configured to manipulate the $TE_{11}$ and $TM_{11}$ modes at high frequencies, while second portion 140 is configured to manipulate the $HE_{11}$ mode at low frequencies. For instance, in one embodiment, the abrupt change in draft angle between section 150 and 155 may cause a mode change from $TE_{11}$ to $TM_{11}$ mode, (i.e. the surface change between the two sections may cause a higher order mode to propagate).

In one embodiment, first portion 120 may operate as a dual mode horn. $TE_{11}$ and $TM_{11}$ modes are the most influential (predominant) modes at high frequency. $HE_{11}$, mode is most influential (predominant) mode at low frequency. Stated another way, (in the first portion 120 of the hybrid horn) the dual mode geometry controls for higher frequency signals and on the other hand (in the second portion 140 of the hybrid horn) the axial corrugated geometry portion controls for lower frequency signals.

In one exemplary embodiment, feed horn 100 includes a series of sections (such as sections 150, 155, 160, 165, 170, 175) with progressively increasing radial dimensions. At least a portion of the sections (such as sections 150, 155, 160, 165, 170, 175) have dimensions pre-selected to convert $TE_{11}$ mode energy to $TM_{11}$ mode energy. In one exemplary embodiment, feed horn 100 comprises a waveguide which is configured to propagate $TE_{11}$ mode energy at a frequency band of interest, such as about 18.3 GHz to about 20.2 GHz and/or 28.1 GHz to about 30 GHz.

A mode conversion section, (such as first section 150, second section 155, third section 160, fourth section 165, fifth section 170 and/or sixth section 175) may be configured to convert a portion of $TE_{11}$ mode energy into $TM_{11}$ mode energy. For instance feed horn 100 is designed so that the vector sums of $TE_{11}$ mode energy and $TM_{11}$ mode energy have a prescribed phase relationship at exit port 180. Tapered sections comprising draft (such as first section 150, second section 155, third section 160, fourth section 165, fifth section 170 and/or sixth section 175) may comprise smooth transitions which may be configured to avoid undesirable mode excitation. The length and draft of the sections (such as first section 150, second section 155, third section 160, fourth section 165, fifth section 170 and/or sixth section 175) are configured to propagate a selected amount of the $TE_{11}$ mode and a selected amount of the $TM_{11}$ mode at the frequency band of interest. Section 155 predominately propagates the $TE_{11}$ mode. The junction between second section 155 and third section 160 results in mode conversion of a portion of the $TE_{11}$ mode energy to the $TM_{11}$ mode. Section 160 has a length that is chosen to provide a particular relative phase condition between the $TE_{11}$, mode and the TM, mode. Section 165 completes the phasing and adjusts the diameter prior to the junction between 165 and 175 where additional $TM_{11}$ mode content is generated.

Tapered sections comprising draft (such as first section 150, second section 155, third section 160, fourth section 165, fifth section 170 and/or sixth section 175) may comprise a phasing section configured to direct a provided signal to be a desired phase upon reaching a location within the feed horn 100 such as, the exit port 180 of the feed horn. In one exemplary embodiment, sections 160 and 165 are configured to be phasing sections. In another exemplary embodiment, the amount of change in draft between sections 160 and 165 may be configured to ease the single draft pull without causing a higher order mode to propagate.

In one exemplary embodiment, sections of feed horn 100 (such as sections 160, 165, 170 and 175) may be configured to have draft changes which facilitates impedance matching. The draft(s) of feed horn 100 may provide a wider bandwidth than legacy feed horn designs having a stepped transition. In one exemplary embodiment, the draft of section 175 may be configured to launch the high frequency energy in a desired direction towards a desired target.

Adjusting the depth, width and number of grooves (such as the grooves associated with groove surfaces 131, 133, 135, 137, 139, 141) and width and number of surfaces (such as protrusion surfaces 130, 132, 134, 136, 138, 140P, 142) of the second portion 140, the feed horn 100 may be configured to respond to electromagnetic signals of different, non-contiguous frequency bands and different modes, separately at the same time. I.e., processing more than one separate mode simultaneously. For instance, second portion 140 may operate as an axial corrugated horn.

The input reflection coefficients of the antenna are configured to be minimum at discrete frequencies (or operating frequencies) where the antenna operates most efficiently. The input reflection coefficient of a corrugated horn may be dominated by the reflection coefficient at the junction of the input waveguide and the commencement of the flare. For instance, in one exemplary embodiment, the input reflection coefficient of feed horn 100 is configured to be measured at the diameter within section 150 of substantially constant diameter.

In one embodiment, the depths of the grooves associated with groove surfaces 131, 133, 135, 137, 139, 141 are gradually decreased from a half wavelength to a quarter wavelength deep as feed horn 100 is widened. By making the last few grooves, such as grooves associated with groove surfaces 137, 139, and 141, close to one-half wavelength deep, the reactance may be close to zero.

In another embodiment, the depths of the grooves can be selected to optimize the operation of the system. In some embodiments, by increasing and/or decreasing the length of one of the side walls of a groove, side lobe levels of the feed horn 100 may be adjusted.

The lack of axial pattern symmetry in simple smooth wall conical horns of constant or slowly varying geometry with $TE_{11}$ excitation, such as feed horn 100, may be overcome by configuring feed horn 100 to introduce the $TM_{11}$ mode along with the dominant $TE_{11}$ mode. Stated another way, the addition of the various flare angle changes facilitates the use of $TM_{11}$ modes along with the dominant $TE_{11}$ mode and predetermined amplitude and phase differences between the modes to provide pattern symmetry and low cross polarization. Configuring feed horn 100 to comprise a transition of appropriate dimension along a feed horn 100 inner-surface may convert a portion of the dominant $TE_{11}$ mode energy into the higher order $TM_{11}$ mode energy. The dimension of the transition may be selected to optimize the operation of the system based on desired system attributes. The amount of energy converted may be a function of the magnitude of the dimension change in the wall. The dimension change in the wall may be selected to optimize the operation of the system. This conversion of a portion of the $TE_{11}$ to $TM_{11}$ mode energy may also suppress side lobes.

Feed horn 100 may be configured to have phase centers, for the plurality of frequencies, that are close together. For example a separate phase center may exist for each separate frequency. In an exemplary embodiment, the high frequency phase center may be located close to the interface between first portion 120 and second portion 140 and the low frequency phase center may be located closer to the aperture 180. Feed horn 100 may be configured to locate these phase centers as near as possible to each other given the desired operating, fabrication, and size, constraints of the system. In one exemplary embodiment, the phase center is directed to the focal point of a provided reflector dish. In one exemplary embodiment, the high frequency focal point is favored for positioning a provided dish. In one exemplary embodiment, the phase centers are located less than 1 wavelength apart at 18.3 GHz. However, other distances for phase centers may be used. It is noted that the phase centers are approximate locations and generally not a precise point.

Figure 6A:
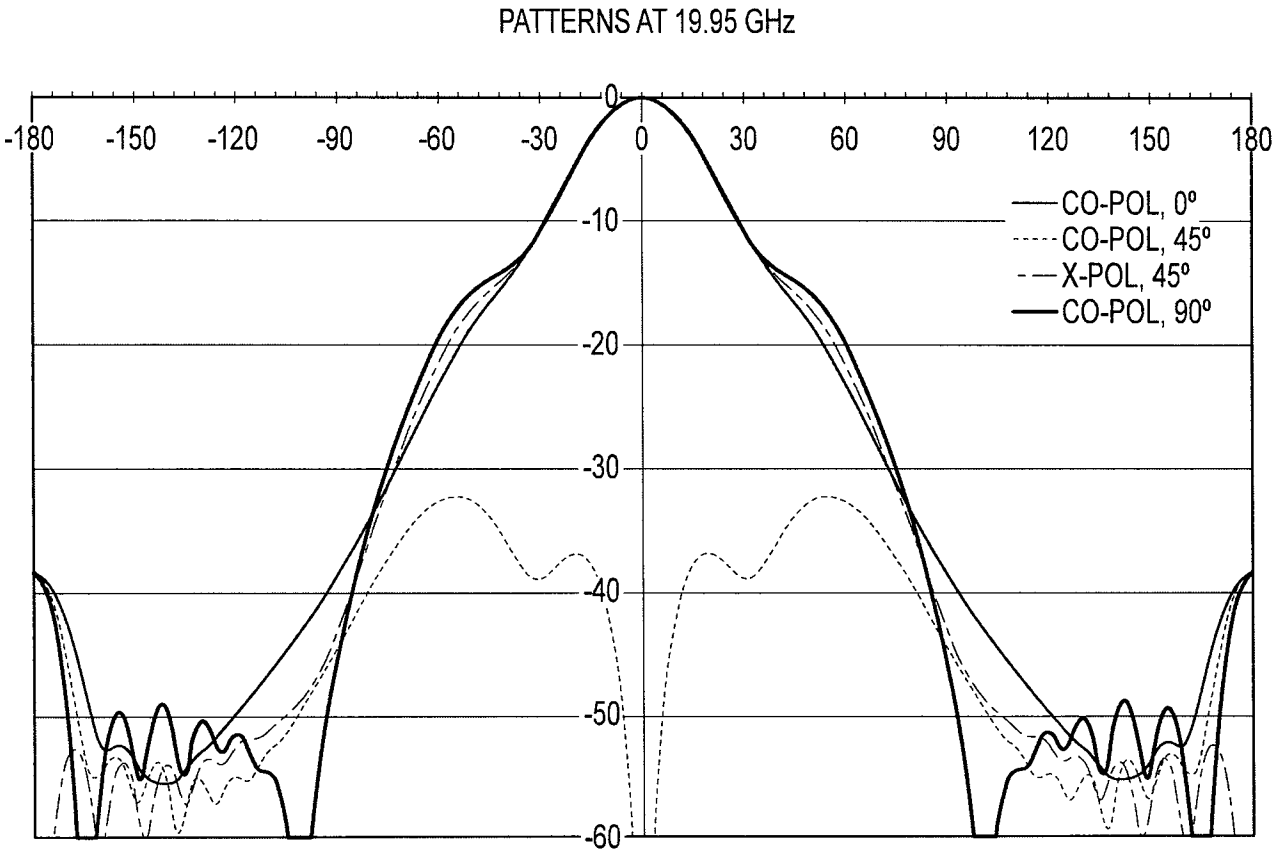
FIGS. 6A and 6B illustrate radiation patterns at various frequencies in various planes in accordance with an exemplary embodiment of the present invention.
Figure 6B:
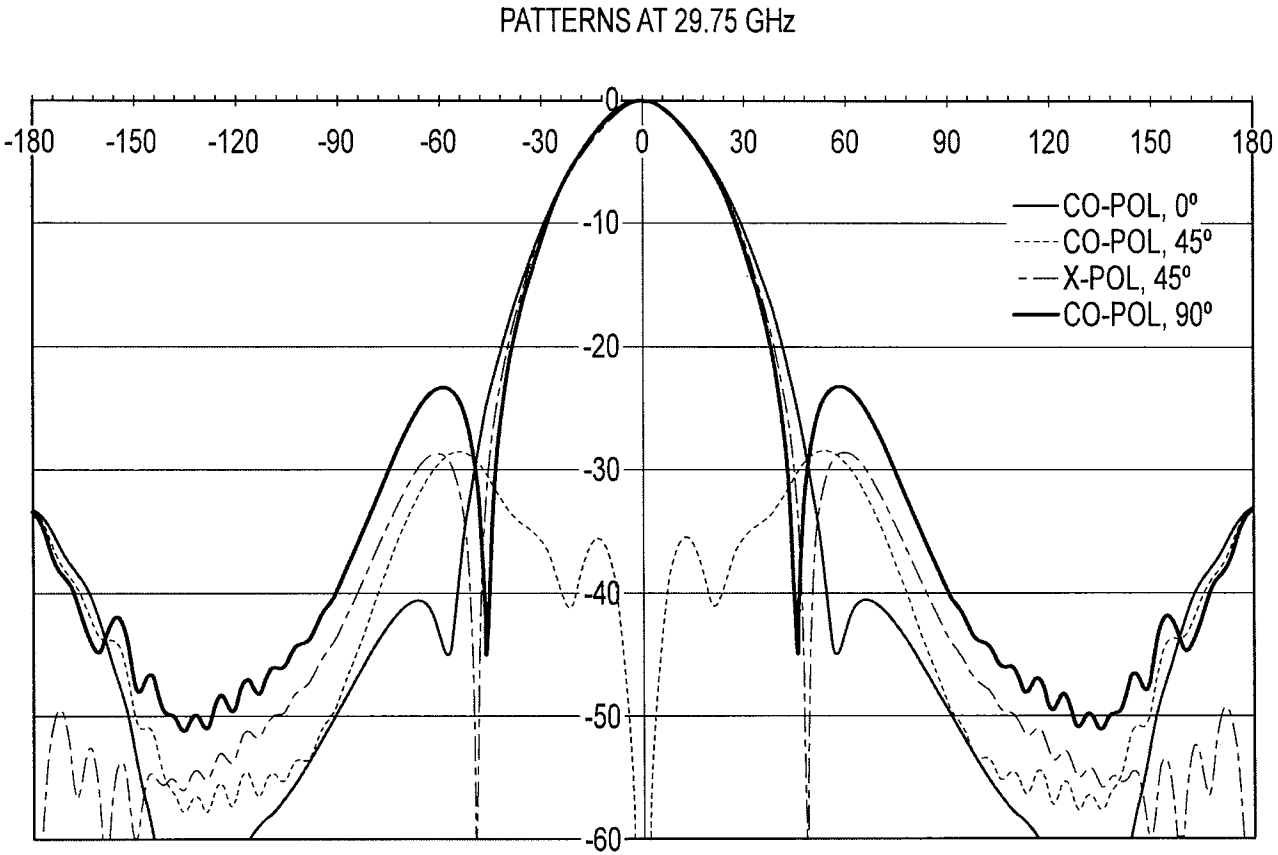

With reference to FIGS. 6A and 6B, an exemplary set of radiation patterns in the cardinal and 45° planes are shown at a sample frequency in the first and second band segments, respectively. The co-polarization in all three pattern cuts and cross-polarization responses is shown in the 45° plane where cross-polarization typically has a maximum value. The co-polarization radiation pattern responses are nearly equal showing a high degree of pattern symmetry. Furthermore, the cross-polarization response in the 45° plane is low having a peak response less than −28 dB relative to the co-polarization responses. The cross-polarization in the cardinal planes is a very low value and is below the range of the plot. For the lower frequency band segment in FIG. 6A the $HE_{11}$ mode is predominate and the radiation pattern is largely produced from the structure of the corrugations within the horn boundary. For the higher frequency band segment, and with reference to FIG. 6B, the $TM_{11}$ mode, when properly phased and combined with the $TE_{11}$ mode, in feed horn 100 may be configured to exert an effect on the horn E-plane aperture distribution and the corresponding radiation pattern. With renewed reference to FIGS. 6A and 6B, the presence of the $TM_{11}$ mode has substantially no effect on the H-plane aperture distribution of feed horn 100, nor on the H-plane radiation pattern. Additionally, in one exemplary embodiment, this conversion of a portion of the $TE_{11}$ to $TM_{11}$ mode energy may produce substantially equal beam widths in the E and H planes. Configuring feed horn 100 to communicate the $TE_{11}$ and $TM_{11}$ modes in the correct phase relationship may result in axisymetrical co-polar radiation patterns with a true phase center and low cross polarization. Additionally, E-plane side lobes may be reduced to at least the level of those in the H-plane.

Figure 5:
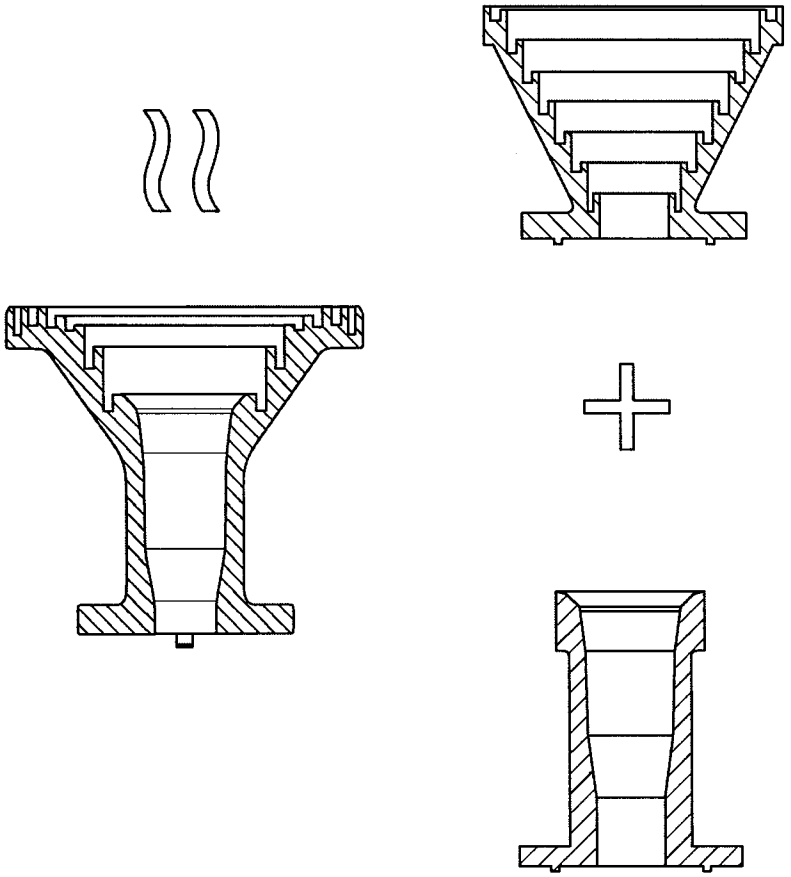
FIG. 5 illustrates in conceptual form the combination of an axial corrugated feed horn and a dual mode feed horn to form a hybrid feed horn.

In one exemplary embodiment with reference to FIG. 5, with respect to high frequencies, such as about 28.1 GHz to about 30.0 GHz, a portion of feed horn 100 may operate as a dual mode horn. With respect to low frequencies, such about 18.3 GHz to about 20.2 GHz, a portion of feed horn 100 may operate as a corrugated horn. Feed horn 100 may operate over a bandwidth of at least 1900 MHz. In another exemplary embodiment, feed horn 100 may operate over a bandwidth of at least 2.5 GHz. Therefore, feed horn 100 melds these two concepts, i.e. melds scalar horn operations with dual horn operation.

In one exemplary embodiment, feed horn 100 may operate over two bandwidth segments of at least 1900 MHz and the upper limit of the first band segment and the lower end of the second band segment are separated by 7900 MHz (for example, a total band from 18.3 GHz to 30 GHz). In this exemplary embodiment, the wavelengths at these two ends of the operating bandwidth is 0.645 inches and 0.393 inches, respectively. In this regard, feed horn 100 is constructed to be less than 4 wavelengths long at 18.3 GHz. In other exemplary embodiments, at 18.3 GHz feed horn 100 is constructed to be less than 3.5, 3.1, or 2.75 wavelengths. Feed horn 100 may be any suitable length, but in an exemplary embodiment it is a short feed horn of approximately the dimensions discussed herein. It is noted that the first section 150 may, in an alternative exemplary embodiment be part of the mating component to which feed horn 100 is mated.

In one exemplary embodiment, feed horn 100 is configured to comprise some properties of a scalar horn and a dual mode horn. The flare angles (e.g. lines B, C, and D with renewed reference to FIG. 2) of feed horn 100 may alter the resultant beam shape. A pre-selected combination of aperture diameter and flare angle can result in high feed efficiency. Once flare dimensions are selected, the phase shift of second portion 140 is calculated and the lengths of the sections of first portion 120 may be selected and/or adjusted. This adjustment may result in the $TE_{11}$ mode and the $TM_{11}$ mode to cancel at the rim and/or exit port 180 of feed horn 100. In one embodiment, cancellation is achieved, and the lack of edge currents result in reduced or nonexistent side lobes. At least partial conversion of the $TE_{11}$ mode energy into $TM_{11}$ mode energy may occur in the second portion 140 of the horn. The first portion 120 of feed horn 100 may be configured to align the phase relationship of the two modes at the aperture. Since the modes propagate at different phase velocities in feed horn 100, the phase velocities may be a function of wave length. Thus, the phase velocities in feed horn 100 may be a function of the size of the diameter(s) at any one cross section and length of the feed horn.

In one exemplary embodiment, feed horn 100 is designed to have low cross polarization. For instance, in one exemplary embodiment, feed horn 100 is configured to have a radiated cross-polarization of less than 25 dB below the co-polarization peak across the frequency band. In one exemplary embodiment, feed horn 100 is configured to have symmetric cross polarization and co-polarization radiation pattern characteristics. In one exemplary embodiment, feed horn 100 is configured to have pattern widths and amplitudes consistent between high band frequencies and low band frequencies. In one exemplary embodiment, feed horn 100 is configured to have close phase centers between high band frequencies and low band frequencies.

In one exemplary embodiment, the architecture of the feed horn is designed with a consideration towards radiation edge illumination angles. In one exemplary embodiment, an edge illumination angle of 9 to 10 dB is desirable for both the high band frequency and low band frequency. In one exemplary embodiment, feed horn 100 may achieve −28 dB (worst case) cross-polarization in the low band and −33 dB (worst case) cross-polarization in the high band.

Various dimension selections may be made in view of the other provided antenna optics, such as a main reflector, and/or sub reflector with respect to optimizing cross-polarization interference cancellation and signal phasing. The geometry of the system may be a function of variables such as fixed input radius and minimum gap width of the provided antenna optics. The system architecture may also be a function of one or more of return loss, maximum co-polar gain, cross-polar gain, phase center variation, aperture efficiency, and selection of dB beamwidth, power handling performance, return loss, side lobe level adjustment, and desired accuracy. In one embodiment, these desirable characteristics are given quantifiable weight and manipulated by a computer program to optimize the geometry and performance of the system.

In an exemplary embodiment and with renewed reference to FIGS. 6A, and 6B, exemplary antenna radiation patterns are depicted. FIG. 6A depicts patterns at 19.95 GHz for an exemplary embodiment of feed horn 100. FIG. 6B depicts patterns at 29.75 GHz for an exemplary embodiment of feed horn 100.

Feed horn 100 may be coupled to a suitable radome. The radome may protect the feed horn 100. The radome may be an A sandwich radome. An A-sandwich radome may comprise low dielectric foam or honeycomb core sandwiched between two thin laminates. Furthermore, the radome may be any radome configured to form a protective cover between an antenna and the environment with minimal impact to the electrical performance of the antenna. In one exemplary embodiment, the radome is electrically invisible. In another exemplary embodiment, the radome is nearly electrically invisible. The radome configuration and materials composition may be configured to match a particular application and radio frequency range.

In accordance with an exemplary embodiment, reciprocity is invoked in this disclosure of exemplary embodiments of the antenna structure and all concepts discussed apply to both the transmit and receive direction of energy propagation.

Benefits, other advantages, and solutions to problems have been described above with regard to specific embodiments. However, the benefits, advantages, solutions to problems, and any element(s) that may cause any benefit, advantage, or solution to occur or become more pronounced are not to be construed as critical, required, or essential features or elements of any or all the statements. As used herein, the terms "includes," "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. Further, no element described herein is required for the practice of the invention unless expressly described as "essential" or "critical."

We claim:

1. A feed horn comprising:

a mode conversion section having a first end and a second end, the mode conversion section to propagate first signals in a higher frequency band and second signals in a lower frequency band between the first end and the second end, and to at least partially convert the first signals in the higher frequency band between a first propagation mode at the first end and a second propagation mode at the second end; and an axial corrugation section to propagate the first signals in the higher frequency band and the second signals in the lower frequency band between the second end of the mode conversion section and an aperture of the feed horn;

the axial corrugation section including protrusions in an axial direction of the feed horn to at least partially convert the second signals in the lower frequency band between the first propagation mode at the second end of the mode conversion section and a third propagation mode at the aperture.

2. The feed horn of claim 1, wherein the feed horn operates as a dual mode horn in the mode conversion section while operating as an axial corrugated horn in the axial corrugation section.

3. The feed horn of claim 2, wherein the higher frequency band is from about 28.1 GHz to about 30.0 GHz, and the lower frequency band is from about 18.3 GHz to about 20.2 GHz.

4. The feed horn of claim 1, wherein the feed horn has an axial length that is less than four times the longest wavelength of the lower frequency band, and wherein the feed horn is in a prime fed offset reflector antenna system.

5. The feed horn of claim 1, wherein:

the mode conversion section predominantly converts the first signals in the higher frequency band between the first propagation mode at the first end and the second propagation mode at the second end;

the mode conversion section propagates the second signals in the lower frequency band predominantly in the first propagation mode from the first end to the second end of the mode conversion section;

the axial corrugation section propagates the first signals in the higher frequency band predominantly in the second propagation mode from the second end of the mode conversion section to the aperture; and the axial corrugation section predominantly converts the second signals in the lower frequency band between the first propagation mode at the second end of the mode conversion section and the third propagation mode at the aperture.

6. The feed horn of claim 1, wherein the feed horn operates over two bandwidth segments of at least 1900 MHz that are separated by at least 5000 MHz.

7. The feed horn of claim 1, wherein the mode conversion section and the axial corrugation section comprise one monolithic unit, and wherein the monolithic unit is formed as a single piece via a single casting pull.

8. The feed horn of claim 1, wherein the first propagation mode is $TE_{11}$, the second propagation mode is $TM_{11}$, and the third propagation mode is $HE_{11}$.

9. The feed horn of claim 1, wherein the feed horn has nearly E- and H-plane symmetric patterns in the higher frequency band and the lower frequency band.

10. A method comprising:

communicating through a feed horn in a plurality of separate frequency bands and a plurality of separate propagation modes, wherein the plurality of separate frequency bands comprise at least a higher frequency band and a lower frequency band; wherein the feed horn comprises:

a mode conversion section having a first end and a second end; and an axial corrugation section, the axial corrugation section comprising corrugations in an axial direction, the second end of the mode conversion section connected to the axial corrugation section at a location opposite a feed horn aperture of the axial corrugation section;

propagating first signals in the higher frequency band and second signals in the lower frequency band between the first end and the second end, and at least partially converting the first signals in the higher frequency band between a first propagation mode at the first end and a second propagation mode at the second end; and propagating the first signals in the higher frequency band and the second signals in the lower frequency band between the second end of the mode conversion section and the feed horn aperture, and at least partially converting the second signals in the lower frequency band between the first propagation mode at the second end of the mode conversion section and a third propagation mode at the feed horn aperture.

11. The method of claim 10, wherein the higher frequency band is about 28.1 GHz to about 30.0 GHz, and the lower frequency band is about 18.3 GHz to about 20.2 GHz.

12. The method of claim 10, wherein the mode conversion section and the axial corrugation section comprise one monolithic unit, wherein the plurality of separate frequency bands comprise one or more of the C band, X band, Ku band, K band, Ka band, Q band, W band or V band, and wherein the feed horn operates over two band segments of at least 1900 MHz bandwidth that are separated by at least 5000 MHz.

13. The method of claim 10, wherein the feed horn has an axial length that is less than four times the longest wavelength of the lower frequency band, with nearly E- and H-plane symmetric patterns, wherein the feed horn is in a prime fed offset reflector antenna system, wherein the mode conversion section and the axial corrugation section comprise one monolithic unit, and wherein the monolithic unit is formed as a single piece via a single casting pull.

14. The method of claim 10, wherein conversion of the propagation modes is dominated by the mode conversion section over the higher frequency band and is dominated by the axial corrugation section over the lower frequency band.

15. The method of claim 10, wherein:

the at least partially converting the first signals in the higher frequency band comprises predominantly converting at least one of the plurality of separate propagation modes of the first signals in the higher frequency band with the mode conversion section of the feed horn; and the at least partially converting the second signals in the lower frequency band comprises predominantly converting at least one of the plurality of separate propagation modes of the second signals in the lower frequency band with the axial corrugation section of the feed horn.

16. A system comprising:

a feed horn to operate in a plurality of separate frequency bands and a plurality of separate propagation modes, wherein the plurality of separate frequency bands comprises at least a first frequency band and a second frequency band, wherein the first frequency band corresponds to a higher frequency range than the second frequency band; the feed horn comprising:

a mode conversion section comprising:

a first end and a second end opposite the first end, wherein the first end is configured to pass first signals in the first frequency band and second signals in the second frequency band;

a plurality of sections, between the first end and the second end, each comprising a section having a length and a draft; and an axial corrugation section, coupled to the mode conversion section and located between a feed horn aperture and the second end of the mode conversion section, the axial corrugation section comprising:

a plurality of protrusions aligned parallel to a central axis of the feed horn, wherein the plurality of protrusions further comprise a plurality of protrusion surfaces each at a predetermined depth from a reference plane, wherein the protrusion surfaces are separated by a plurality of grooves; wherein the thickness of each groove is predetermined and the depth of each groove is predetermined; and wherein the mode conversion section predominantly propagates two modes of the first signals in the first frequency band, and wherein the axial corrugation section predominantly propagates a hybrid mode of the second signals in the second frequency band.

17. The system of claim 16, the plurality of sections further comprising:

a first section comprising a first draft and a first length;

a second section comprising a second length and a second draft;

a third section comprising a third length and a third draft;

a fourth section comprising a fourth length and a fourth draft; and a fifth section comprising a section of a fifth length and a fifth draft; and wherein the plurality of protrusion surfaces further comprises:

a first protrusion surface at a first depth from the reference plane, separated from a second protrusion surface at a second depth from the reference plane by a first groove; wherein the thickness of the first groove is a first thickness; and the depth of the first groove is a first groove depth;

the second protrusion surface, separated from a third protrusion surface at a third depth from the reference plane by a second groove; wherein the thickness of the second groove is a second thickness; and the depth of the second groove is a second groove depth;

the third protrusion surface, separated from a fourth protrusion surface at a fourth depth from the reference plane by a third groove; wherein the thickness of the third groove is a third thickness; and the depth of the third groove is a third groove depth;

the fourth protrusion surface, separated from a fifth protrusion surface at a fifth depth from the reference plane by a fourth groove; wherein the thickness of the fourth groove is a fourth thickness; and the depth of the fourth groove is a fourth groove depth;

the fifth protrusion surface, separated from a sixth protrusion surface at a sixth depth from the reference plane by a fifth groove; wherein the thickness of the fifth groove is a fifth thickness; and the depth of the fifth groove is a fifth groove depth; and the sixth protrusion surface, separated from a seventh protrusion surface at a seventh depth from the reference plane by a sixth groove; wherein the thickness of the sixth groove is a sixth thickness; and the depth of the sixth groove is a sixth groove depth.

18. The system of claim 17, wherein the first protrusion surface comprises one of substantially circular shape or substantially elliptical shape, and wherein the mode conversion section and the axial corrugation section comprise zinc or aluminum.

19. The system of claim 16, wherein the mode conversion section and the axial corrugation section are formed through casting, wherein the mode conversion section further comprises at least one phasing section, and wherein the feed horn comprises a plurality of flare angles, wherein the feed horn has nearly E- and H-plane symmetric patterns, wherein the system further comprises a prime fed offset reflector antenna system coupled to the feed horn, wherein the mode conversion section and axial corrugation section comprise one monolithic unit, and wherein the monolithic unit is formed as a single piece via a single casting pull, and wherein the feed horn axial length is less than four times the longest wavelength of the lower frequency band.

20. The system of claim 19, wherein, in the axial corrugation section, the flare angles increase successively towards an aperture of the feed horn.

21. The system of claim 16, wherein the feed horn axial length is less than four times the longest wavelength of the second frequency band.

22. The system of claim 16, wherein the plurality of separate propagation modes include one or more of $TE_{11}$ mode, $TM_{11}$ mode, or $HE_{11}$ mode, wherein the plurality of separate frequency bands comprise one or more of the C band, X band, Ku band, K band, Ka band, Q band, W band or V band, and wherein the first frequency band and the second frequency band each have at least 1900 MHz bandwidth.

23. A feed horn to operate in a plurality of separate frequency bands and a plurality of separate propagation modes, wherein the plurality of separate frequency bands comprises at least a first frequency band and a second frequency band, wherein the first frequency band corresponds to a higher frequency range than the second frequency band, the feed horn comprising:

a mode conversion section of the feed horn comprising a first end and a second end opposite the first end; and an axial corrugation section, the axial corrugation section coupled to the mode conversion section and located between a feed horn aperture and the second end of the mode conversion section, the axial corrugation section further comprising a plurality of protrusions aligned parallel to a central axis of the feed horn;

wherein the feed horn has an axial length of less than four wavelengths at 18 GHz and wherein the first frequency band and the second frequency band each have greater than or equal to 1900 MHz bandwidth;

and wherein mode conversion is dominated by the mode conversion section over the first frequency band and dominated by the axial corrugation section over the second frequency band.

24. The system of claim 23, wherein the feed horn communicates in a plurality of separate waveguide modes, wherein the plurality of separate waveguide modes include one or more of $TE_{11}$ mode, $TM_{11}$ mode, or $HE_{11}$ mode.

* * * * *

UNITED STATES PATENT AND TRADEMARK OFFICE

CERTIFICATE OF CORRECTION

PATENT NO. : 8,730,119 B2
APPLICATION NO. : 13/030942
DATED : May 20, 2014
INVENTOR(S) : Donald L Runyon and David M Kokotoff It is certified that error appears in the above-identified patent and that said Letters Patent is hereby corrected as shown below:

On the Title Page, item (57) in the Abstract
In line 7, delete "29.1 GHz" and insert --28.1 GHz--;

In the Specification
In column 2, line 11, delete "29.1 GHz" and insert --28.1 GHz--.

Signed and Sealed this
Ninth Day of December, 2014

Michelle K. Lee

Michelle K. Lee
*Deputy Director of the United States Patent and Trademark Office*